US012791232B2

(12) United States Patent
Tannert

(10) Patent No.: US 12,791,232 B2
(45) Date of Patent: Nov. 10, 2026

(54) REFRIGERANT CIRCUIT AND HEAT PUMP

(71) Applicant: Viessmann Climate Solutions SE, Allendorf (DE)

(72) Inventor: Thomas Tannert, Radebeul (DE)

(73) Assignee: Viessmann Climate Solutions SE, Allendorf (DE)

( * ) Notice: Subject to any disclaimer, the term of this patent is extended or adjusted under 35 U.S.C. 154(b) by 105 days.

(21) Appl. No.: 18/773,499

(22) Filed: Jul. 15, 2024

(65) Prior Publication Data

US 2025/0027692 A1 Jan. 23, 2025

(30) Foreign Application Priority Data

Jul. 21, 2023 (DE) ..... 10 2023 119 273.6
Jan. 26, 2024 (EP) ..... 24154257

(51) Int. Cl.
*F25B 30/02* (2006.01)
*F25B 41/20* (2021.01)
*F25B 41/40* (2021.01)

(52) U.S. Cl.
CPC ..... *F25B 30/02* (2013.01); *F25B 41/20* (2021.01); *F25B 41/40* (2021.01)

(58) Field of Classification Search
CPC ..... F25B 41/26; F25B 2313/02742; F16K 11/22; F16K 27/003
(Continued)

(56) References Cited

U.S. PATENT DOCUMENTS 4,645,908 A * 2/1987 Jones ..... F24D 11/0214 392/464
6,817,205 B1 11/2004 Lifson et al.
(Continued)

FOREIGN PATENT DOCUMENTS

DE 10065112 A1 7/2002
DE 10162785 B4 3/2005
(Continued)

OTHER PUBLICATIONS

Extended European Search Report dated Jul. 17, 2024 for EPO App. Ser. No. EP24154257.0, with English translation.
(Continued)

*Primary Examiner* — Steve S Tanenbaum
(74) *Attorney, Agent, or Firm* — Henricks Slavin LLP

(57) ABSTRACT

The present invention relates to a refrigerant circuit, in particular a refrigerant circuit for a heat pump, and a heat pump for heating and cooling a building. The refrigerant circuit comprises a first heat exchanger (8), which is configured to function as an evaporator or as a condenser, and a second heat exchanger (7), which is also configured to function as a condenser or as an evaporator. Furthermore, the refrigerant circuit comprises a compression section (90), which is arranged downstream of the first heat exchanger (8) or downstream of the second heat exchanger (7), an expansion section (20), which is arranged downstream of the second heat exchanger (8) or downstream of the first heat exchanger (7), a first way valve (3), which is configured to supply refrigerant to the expansion section (20) and discharge refrigerant from the expansion section (20), and a second way valve (4), which is configured to supply refrigerant to the compression section (90) and discharge refrigerant from the compression section (90).

17 Claims, 2 Drawing Sheets

(58) Field of Classification Search
USPC ..... 62/324
See application file for complete search history.

(56) References Cited

U.S. PATENT DOCUMENTS

| | | | | |
|---|---|---|---|---|
| 7,100,384 | B2 * | 9/2006 | Leuthner | F25B 13/00 62/160 |
| 2003/0154730 | A1 | 8/2003 | Leuthner et al. | |
| 2023/0341158 | A1 * | 10/2023 | Yu | F25B 13/00 |

FOREIGN PATENT DOCUMENTS

| | | | | |
|---|---|---|---|---|
| DE | 102018108013 | A1 | 10/2019 | |
| EP | 1471316 | A1 | 10/2004 | |
| EP | 1980803 | B1 | 3/2021 | |
| WO | WO 2009/087733 | A1 | 7/2009 | |
| WO | WO-2024070872 | A1 * | 4/2024 | F25B 49/02 |

OTHER PUBLICATIONS

Office Action dated Apr. 8, 2024 for DE App. Ser. No. 10 2023 119 273.6, with English translation.

* cited by examiner

REFRIGERANT CIRCUIT AND HEAT PUMP

The present invention relates to a refrigerant circuit, in particular a refrigerant circuit for a heat pump and a heat pump for heating and cooling a building.

BACKGROUND TO THE INVENTION

Heat pumps allow freely available energy from the environment to be used to heat and/or cool a building, thus helping to reduce CO2 emissions in the building sector. In particular, a refrigerant circuit of a heat pump can be used for both heating and cooling, in that heat exchangers included in it can be used both as evaporators and condensers. For example, by reversing the refrigerant circuit, a heat exchanger that functions as a condenser in heating mode can function as an evaporator in cooling mode and vice versa, whereby, for example, a secondary circuit of the corresponding heat exchanger can emit heat to the building in heating mode and absorb heat from the building in cooling mode. The refrigerant circuit can be reversed in different ways.

In this context, European patent EP 1 980 803 B1 shows a heat pump device comprising a compressor, a condenser, an expansion valve, an evaporator and first and second switching valves, in which the first and second switching valves are arranged such that the compressor, the condenser, the expansion valve and the evaporator are each coupled at their first end to the first switching valve and at their second end to the second switching valve, whereby the evaporator and the condenser are flowed through in the same direction during both heating and cooling.

Depending on a type of heat exchanger used, however, it may be advantageous to flow through a primary side of the heat exchanger in the opposite direction if it is operated as an evaporator instead of a condenser and vice versa. However, this can lead to increased complexity of the refrigerant circuit, as two expansion valves, e.g. before and after a refrigerant receiver, may be required to supply refrigerant to the respective evaporator in both flow directions.

It is an object of the present invention to provide a refrigerant circuit with alternating flow direction of the heat exchangers in case of circuit reversal, which has a compact design and does not require any additional components (actuators, sensors).

In order to solve the object, the features of the independent claims are proposed. Advantageous embodiments can be found in the dependent claims.

DISCLOSURE OF THE INVENTION

A refrigerant circuit according to the invention comprises a first and a second heat exchanger, each of the two heat exchangers being configured to function as an evaporator or as a condenser.

The refrigerant circuit can be used in particular in a heat pump for heating and cooling a building, whereby the heat pump can in particular be an air-water or brine-water heat pump. The first heat exchanger can, for example, be configured to absorb heat from an external environment (e.g. from outside air, ambient air, geothermal probe, ground collector) of the building as an evaporator and to release heat to the external environment of the building as a condenser. For example, the first heat exchanger can be a fin-tube heat exchanger. The second heat exchanger, on the other hand, can be configured to release heat to a heating/cooling circuit of the building as a condenser and to absorb heat from the heating/cooling circuit of the building as an evaporator. For example, the second heat exchanger can be designed as a plate heat exchanger. To heat the building, the first heat exchanger can operate as an evaporator and the second heat exchanger as a condenser. In return, the second heat exchanger can operate as an evaporator and the first heat exchanger as a condenser to cool the building.

However, it is also possible for the refrigerant circuit to be used in air conditioners and/or refrigeration systems.

In addition to the two heat exchangers, the refrigerant circuit includes a compression section arranged downstream of the first heat exchanger or downstream of the second heat exchanger. In particular, the compression section can be arranged downstream of the one of the two heat exchangers that functions as an evaporator. In other words, the compression section can be arranged between the heat exchanger that is currently operating as an evaporator and the heat exchanger that is currently operating as a condenser.

In particular, the compression section can have at least one compressor with which the vapour refrigerant emerging from the heat exchanger functioning as an evaporator can be compressed from a low pressure level to a high pressure level (condensation pressure). A pressure and temperature sensor can be fitted in the compression section upstream and downstream of the compressor, and an additional safety high pressure switch can be fitted downstream of the compressor.

Furthermore, the refrigerant circuit includes an expansion section arranged downstream of the second heat exchanger or downstream of the first heat exchanger. In particular, the expansion section can be arranged downstream of the one of the two heat exchangers that functions as a condenser. In other words, the expansion section can be arranged between the heat exchanger that is currently operating as a condenser and the heat exchanger that is currently operating as an evaporator.

According to an embodiment, the expansion section can have at least one refrigerant receiver and at least one expansion valve, wherein the expansion valve can in particular be arranged downstream of the refrigerant receiver. Refrigerant that is not required can be stored in the refrigerant receiver under varying boundary conditions of the refrigerant circuit and released again as required. A filter can also be arranged in the expansion section between the refrigerant receiver and the expansion valve to protect the expansion valve from particles. The expansion valve can be a thermostatic or an electronic expansion valve. The latter can, for example, be controlled by a computing unit, such as a heat pump controller, depending on the pressure and temperature of the refrigerant upstream of the compressor. In particular, the expansion valve can be used to control overheating of the refrigerant upstream of the compressor so that it is always provided in vapour form when it enters the compressor. The individual elements of the expansion section can be connected to each other with refrigerant pipes/refrigerant ducts.

Furthermore, the refrigerant circuit comprises a first way valve, which is configured to supply refrigerant to the expansion section and discharge refrigerant from the expansion section, and a second way valve, which is configured to supply refrigerant to the compression section and discharge refrigerant from the compression section. In other words, the first way valve switches refrigerant flows that affect the expansion section, and the second way valve switches refrigerant flows that affect the compression section. In particular, the first and second way valves can be 4/2-way valves.

In particular, the first way valve is used to supply refrigerant from the heat exchanger that is currently operating as a condenser (hereinafter referred to as the "respective condenser") to the expansion section and then to the heat exchanger that is currently operating as an evaporator (hereinafter referred to as the "respective evaporator").

According to an embodiment, a first connection of the first way valve can be connected to one end of the expansion section and a second connection of the first way valve can be connected to another end of the expansion section. The expansion section can have corresponding refrigerant pipes/ducts for this purpose. Thus, the first connection of the first way valve can form an inlet into the expansion section and the second connection of the first way valve can form an outlet from the expansion section. In particular, the first way valve can be configured to direct a refrigerant flow emerging from the respective condenser via the first connection into the expansion section, e.g. to the refrigerant receiver, and to supply it to the respective evaporator via the expansion valve and the second connection from the expansion section. For this purpose, the first and second heat exchanger can be connected to the first way valve by means of corresponding refrigerant pipes/refrigerant ducts.

In turn, the second way valve is used in particular to feed refrigerant from the respective evaporator into the compression section and to supply hot gas from the compression section to the respective condenser.

According to an embodiment, a first connection of the second way valve can be connected to one end of the compression section and a second connection of the second way valve can be connected to the other end of the compression section (90). Thus, the first connection of the second way valve can form an inlet into the compression section and the second connection of the second way valve can form an outlet from the compression section. In particular, the second way valve can be configured to direct a refrigerant flow (low-pressure suction gas flow) emerging from the respective evaporator into the compression section via the first connection and supply compressed hot gas emerging from the compressor to the respective condenser via the second connection from the compression section. For this purpose, the first and second heat exchanger can be connected to the second way valve by means of further refrigerant pipes/ducts. In addition, refrigerant pipes can be arranged within the compression section, which, for example, connect the compressor to the first and second connections of the second way valve. A filter can also be arranged in the compression section upstream of the first connection of the second way valve, which can protect the second way valve from particles.

According to an embodiment, the first and second way valves can be switched synchronously from a first position to a second position and vice versa. In each of the two positions, the two way valves can be switched in such a way that one of the two heat exchangers functions as an evaporator and the other as a condenser.

According to an embodiment, when the first and second way valves are each in their first position, the first heat exchanger can operate as an evaporator and the second heat exchanger as a condenser. For this purpose, the first heat exchanger can be connected to the second connection and the second heat exchanger can be connected to the first connection of the first way valve. In other words, the first way valve can be switched in its first position in such a way that a high-pressure liquid refrigerant flow emerging from the second heat exchanger enters the expansion section via the first connection of the first way valve and is supplied from there as a two-phase low-pressure refrigerant flow to the first heat exchanger for complete evaporation via the second connection of the first way valve.

At the same time, according to an embodiment, in this case the first heat exchanger can be connected to the first connection and the second heat exchanger can be connected to the second connection of the second way valve. In particular, the second way valve can be switched in its first position in such a way that the gaseous refrigerant flow emerging from the first heat exchanger enters the compression section to the compressor via the first connection of the second way valve and returns to the second heat exchanger as a high-pressure hot gas flow via the second connection of the second way valve.

Conversely, in a further embodiment, the first heat exchanger can operate as a condenser and the second heat exchanger as an evaporator when the first and second way valves are each in their second position (reversal of the refrigerant circuit). For this purpose, the second heat exchanger can be connected to the second connection and the first heat exchanger can be connected to the first connection of the first way valve. In other words, the first way valve can be switched to its second position in such a way that a high-pressure liquid refrigerant flow emerging from the first heat exchanger enters the expansion section via the first connection of the first way valve and is supplied from there as a two-phase low-pressure refrigerant flow to the second heat exchanger for complete evaporation via the second connection of the first way valve.

At the same time, according to an embodiment, in this case the second heat exchanger can be connected to the first connection and the first heat exchanger can be connected to the second connection of the second way valve. In particular, the second way valve can be switched in its second position in such a way that the gaseous refrigerant flow emerging from the second heat exchanger enters the compression section to the compressor via the first connection of the second way valve and returns to the first heat exchanger as a high-pressure hot gas flow via the second connection of the second way valve.

In particular, the expansion section can be flowed through in the same direction in both positions of the first and second way valves. This is ensured by the described interconnection of the refrigerant circuit elements by means of the first and second way valves, which allows not only the compression section with the compressor, but also the expansion section with the refrigerant receiver and the expansion valve to always flow in the same direction even when the refrigerant circuit is reversed, while the first and second heat exchangers change their flow direction according to their function as an evaporator or condenser.

In other words, a sequential order of the elements of the expansion section remains the same in both switching positions of the first and second way valve, i.e. the refrigerant receiver is always located upstream of the expansion valve, which means that a supply of liquid refrigerant is always available at its inlet. In addition, no further elements, e.g. no second expansion valve, are required in the expansion section and no further sensors are required for superheat control by the expansion valve when the refrigerant circuit is reversed.

Conversely, the direction of flow through the two heat exchangers changes when the switching positions of the first and second way valves change and the refrigerant circuit is reversed as a result. Depending on the selected heat exchanger design, this can supply advantages, e.g. in view of gravity support in the direction of flow in upright plate heat exchangers and/or in view of a sequence of flow-through components in fin-and-tube heat exchangers, which can have a positive influence on pressure loss.

In order to cause a synchronised switchover from one position to the other, the two way valves can be actuated simultaneously, for example. For this purpose, the first and second way valves can be actuated via an electromagnetic or an electromotive actuating element, for example.

Alternatively, the first and second way valves can have a common actuating element to switch synchronously/simultaneously from the first position to the second position and vice versa. Here too, the actuating element can be an electromagnetic or electromotive actuating element, for example. A "common actuating element" shall be understood to mean that both way valves are actuated by a single actuating element/actuator and a "hard" coupling, e.g. a mechanical coupling, is provided between the two way valves.

According to an embodiment, the first and second way valves can be designed as one component/actuator. For example, the first and second way valves can be designed as a block valve and integrated in a common housing. This allows the two way valves to be realised as a compact unit.

According to an embodiment, the expansion section can have a third heat exchanger, which can be connected to the first connection of the first way valve and the first connection of the second way valve. Further, the third heat exchanger may additionally be connected to a suction gas pipe of the compressor in the compression section and an inlet of the refrigerant receiver in the expansion section.

According to an embodiment, the third heat exchanger can be configured to transfer thermal energy from a high-pressure pipe to a low-pressure pipe of the refrigerant circuit. The high-pressure pipe can be arranged in a passage of the refrigerant circuit that is located between an outlet of the compressor and an inlet of the expansion valve. Similarly, the low-pressure pipe can be arranged in a passage of the refrigerant circuit that is located between an outlet of the expansion valve and an inlet of the compressor. In particular, the low-pressure pipe can be the suction gas pipe of the compressor.

In particular, the third heat exchanger may be an internal heat exchanger whose primary side is connected to the first connection of the first way valve so that it is arranged in the expansion section upstream of the refrigerant receiver. A secondary side of the internal heat exchanger can be connected to the first connection of the second way valve and thus be connected upstream of the compressor in the compression section. In this way, the internal heat exchanger can be used for suction gas superheating upstream of the compressor, allowing the respective evaporator to work more efficiently.

The direct connection of the third heat exchanger to the first connection of the first and second way valves (inlet of the expansion and compression sections) results in the primary and secondary sides of the heat exchanger always flowing in the same direction in both switching positions of the way valves, allowing an internal heat exchanger to be integrated into a refrigerant circuit with just one expansion valve. The internal heat exchanger serves to increase efficiency in the refrigerant circuit and allows a higher temperature spread between the primary heat source and the secondary circuit.

It can be seen that the refrigerant circuit disclosed here allows a compact design, in particular due to the constant flow through the expansion section when the circuit is reversed and the design of the first and second way valves, while at the same time offering advantages by changing the direction of flow through the heat exchangers.

DETAILED DESCRIPTION OF PREFERRED DESIGN EXAMPLES

In the following, design examples of the present invention are described in detail with reference to exemplary figures. The features of the design examples can be combined in whole or in part, and the present invention is not limited to the design examples described. In the figures, identical or comparable elements are provided with identical reference signs, so that a repeated description of the elements is omitted unless this is necessary.

Figure 1A:
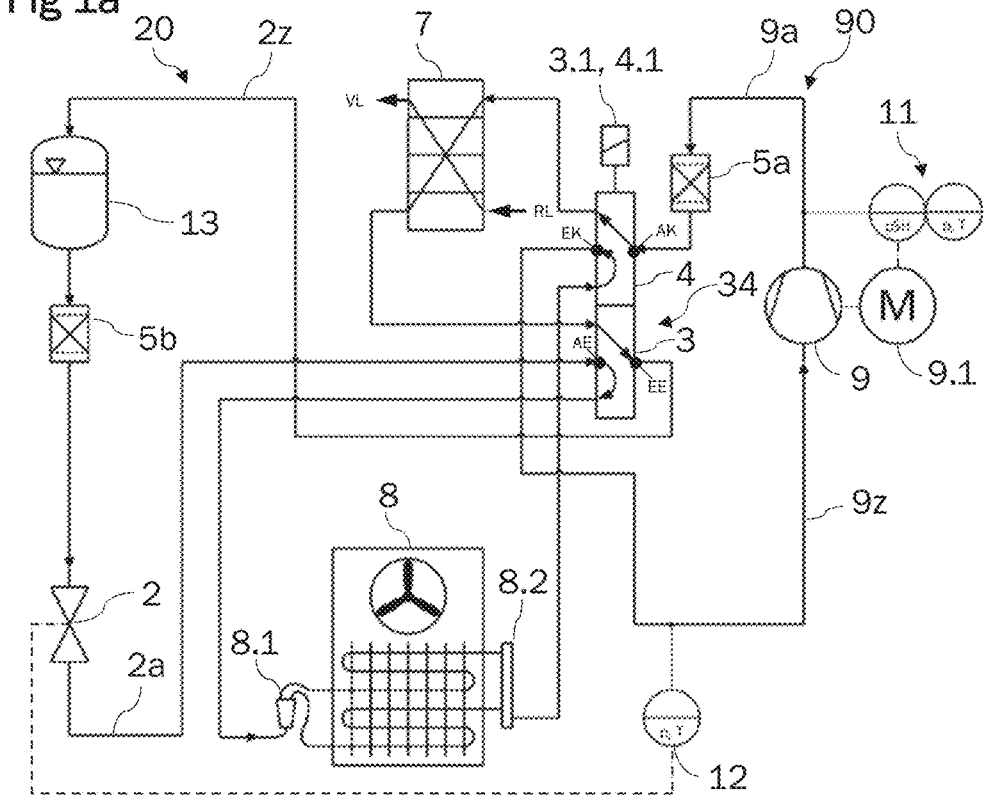
FIGS. 1*a* and 1*b* each schematically show a flow diagram of a refrigerant circuit according to a design example of the invention, wherein a first and second way valve of the refrigerant circuit are in a first position in FIGS. 1*a* and 1*n* a second position in FIG. 1*b*.
Figure 1B:
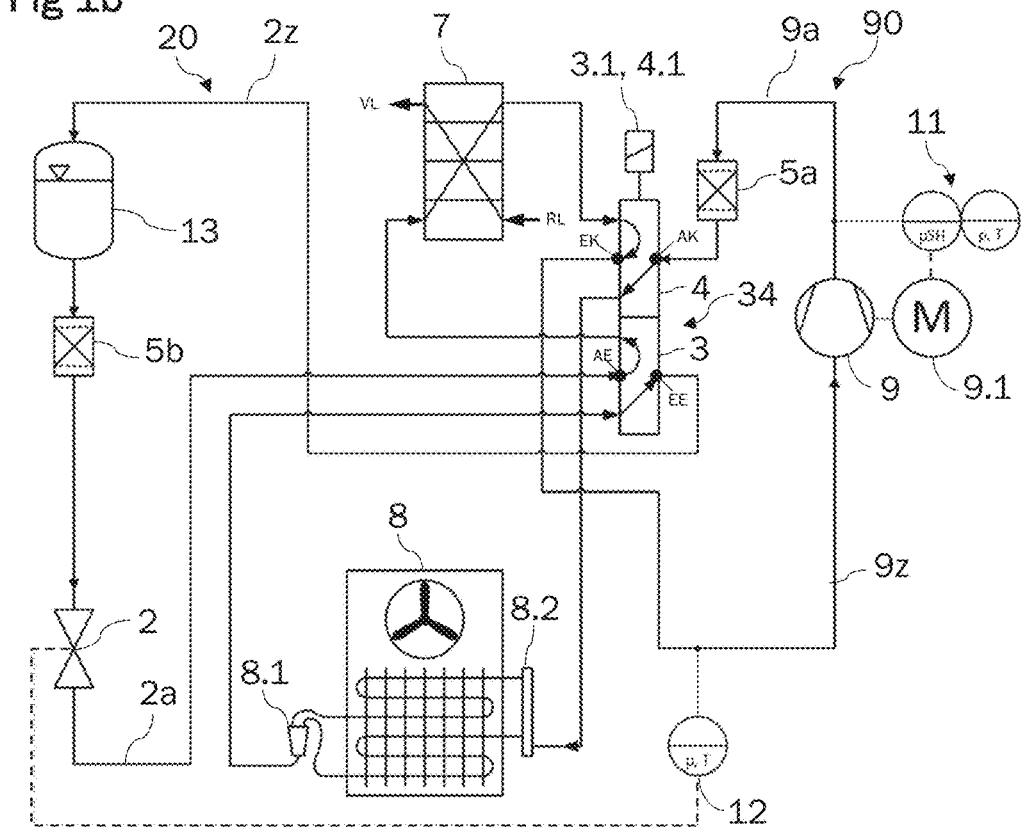

FIGS. 1*a* and 1*b* each schematically show a flow chart of a refrigerant circuit according to a design example of the invention. The refrigerant circuit can in particular be included in a heat pump for heating and cooling a building and comprises a first heat exchanger 8, a second heat exchanger 7, a compression section 90, an expansion section 20 as well as a first way valve 3 and a second way valve 4, which can be switched from a first position to a second position and vice versa by means of a first and second actuating element 3.1, 4.1.

The first and second way valves 3, 4 are designed here as 4/2-way valves. Moreover, in the depicted design example, the first and second actuating elements 3.1, 4.1 are designed as a common actuating element and the first and second way valves 3, 4 are designed as a common component/actuator 34. In particular, the actuator 34 can be a block valve 34. The depicted design of the first and second way valves 3, 4 as a single actuator 34 including both way valves 3, 4, ensures synchronous switching from one position of the two way valves to another position.

However, it is also possible for the two way valves 3, 4 to be designed as individual actuators, which can also have individual actuating elements 3.1, 4.1. In this case, synchronised switching can be implemented, for example, by means of a common drive signal. Alternatively, the two individual way valves 3, 4 can be actuated by means of a common actuating element.

Here, the compression section 90 includes a first refrigerant pipe 9*z*, a compressor 9 with a motor 9.1 and a second refrigerant pipe 9*a*. The first refrigerant pipe 9*z* of the compression section 90 connects a first connection EK of the second way valve 4 to an input of the compressor 9, and the second refrigerant pipe 9*a* of the compression section 90 connects an output of the compressor 9 to a second connection AK of the second way valve 4. The first connection EK of the second way valve 4 represents an input and the second connection AK of the second way valve 4 represents an output of the compression section 90. A pressure and temperature sensor 12 is fitted in the first refrigerant pipe 9*z* upstream of the compressor 9 and a safety high pressure switch 11 is fitted in the second refrigerant pipe 9*a* downstream of the compressor. The high-pressure safety switch 11 is connected to the compressor motor 9.1 by signalling (indicated by a thin dashed line between these elements) in order to switch it off if a refrigerant pressure downstream of the compressor exceeds a predetermined, safety-critical value. In addition, a filter 5*a* is arranged in the second refrigerant pipe 9*a* upstream of the second connection AK of the second way valve 4, which protects it from any particles from the refrigerant circuit.

Here, the expansion section 20 includes a first refrigerant pipe 2*z*, a refrigerant receiver 13, a second refrigerant pipe 2*i*, in which a filter 5*b* is arranged, protecting a downstream expansion valve from particles, and a third refrigerant pipe 2*a*. The expansion valve 2 is connected to the pressure and temperature sensor 12 in the first refrigerant pipe 9*z* of the compression section 90 by signalling (indicated by a thin dashed line between these elements) in order to control overheating of the refrigerant entering the compressor 9. Instead of the combined pressure and temperature sensor 12, separate sensors can also be used to measure the pressure and temperature upstream of the compressor 9.

The first refrigerant pipe 2*z* of the expansion section 20 connects a first connection EE of the first way valve 3 to the refrigerant receiver 13, the second refrigerant pipe 2*i* of the expansion section 20 connects the refrigerant receiver 13 to the expansion valve 2 and the third refrigerant pipe 2*a* of the expansion section 20 connects the expansion valve 2 to a second connection AE of the first way valve 3. The first connection EE of the first way valve 3 represents an input and the second connection AE of the first way valve 4 represents an output of the expansion section 20.

Here, the first heat exchanger 8 is designed as a fin-and-tube heat exchanger with unspecified vertical fins and two unspecified, essentially horizontally arranged coils. The tube coils are connected at one end to a refrigerant distributor 8.1, which is attached to a first refrigerant connection of the first heat exchanger 8. The refrigerant distributor 8.1 can be a venturi distributor, for example. A manifold 8.2 is arranged vertically at an opposite second refrigerant connection of the first heat exchanger 8, into which the two coils open with their other end. The first and second refrigerant connection of the first heat exchanger 8 can serve as a refrigerant inlet or outlet, depending on its function. For example, the first heat exchanger 8 can be configured to absorb heat from an external environment (e.g. outside air, ambient air) of the building or to emit heat to the external environment of the building.

In the present case, the second heat exchanger 7 is designed as a vertically arranged plate heat exchanger, which can be connected on its secondary side, for example, to a heating/cooling circuit of the building (see arrows VL, RL indicating a flow and a return, for example, of a heating/cooling circuit of a building). The second heat exchanger 7 comprises two unspecified refrigerant connections, which serve as a refrigerant inlet or outlet depending on the function of the second heat exchanger 7. A first of the two refrigerant connections is attached to an upper end and a second to a lower end of the second heat exchanger 7.

In FIG. 1*a*, the block valve 34 with the first and second way valves 3, 4 is in a first position (first position of the first and second way valves) in which the depicted refrigeration circuit can be used, for example in a heat pump, to heat a building. In this case, the first heat exchanger 8 serves as an evaporator, which absorbs heat from the external environment of the building, and the second heat exchanger 7 serves as a condenser, which releases heat to the heating/cooling circuit of the building.

For this purpose, in its first position, the first way valve 3 connects the second, lower refrigerant connection of the second heat exchanger 7 or an unspecified refrigerant pipe connected thereto to the first connection EE of the first way valve 3, so that liquid refrigerant under high pressure enters the expansion section 20 and is conducted to the refrigerant receiver 13 by means of its first refrigerant pipe 2*z*. From there, the refrigerant passes via the filter 5*b* in the second refrigerant pipe 2*i* of the expansion section 20 to the expansion valve 2, by means of which the refrigerant is expanded. The refrigerant, which is now in two phases, then flows via the third refrigerant pipe 2*a* of the expansion section 20 to the second connection AE of the first way valve 3, via which the refrigerant is conducted from the expansion section 20 to the first heat exchanger 8 when the first way valve 3 is in the first position. For this purpose, a further unspecified refrigerant pipe connects the second connection AE of the first way valve 3 in its first position to the refrigerant distributor 8.1, via which the refrigerant enters the first heat exchanger 8. The refrigerant distributor 8.1 causes a further throttling of the refrigerant flow, which results in a uniform distribution of the refrigerant in the coils of the first heat exchanger 8, in which the refrigerant is then completely vaporised or superheated. For this purpose, a position/an opening cross-section of the expansion valve 2 is controlled according to the pressure and temperature measured by the sensor 12 upstream of the compressor 9, so that, for example, only as much refrigerant enters the first heat exchanger 8 as can be vaporised/overheated.

The vaporised or superheated refrigerant leaves the first heat exchanger 8 via the manifold 8.2 and flows from there via a further, unspecified refrigerant pipe to the second way valve 4, which in its first position connects the first connection EK to this refrigerant pipe. From there, the gaseous refrigerant flows via the first refrigerant pipe 9*z* of the compression section 90 to the compressor 9, in which it is compressed, and then flows at a high pressure level via the filter 5*a* to the second connection AK of the second way valve 4, which in its first position is connected to the first refrigerant connection of the second heat exchanger 7 via an unspecified refrigerant pipe. The gaseous, compressed refrigerant thus enters the second heat exchanger 7 via its upper connection in order to condense in it, and emerges again as liquid refrigerant from its lower connection. Due to the refrigerant flow from the upper first connection to the lower second connection during condensation in the second heat exchanger 7, the outlet of the liquid refrigerant from the second heat exchanger 7 is assisted by gravity.

In FIG. 1*b*, however, the block valve 34 with the first and second way valves 3, 4 is in a second position (second position of the first and second way valves) in which the depicted refrigeration circuit can be used, for example in a heat pump, to cool a building. In this case, the first heat exchanger 8 serves as a condenser, which releases heat to the external environment of the building, and the second heat exchanger 7 serves as an evaporator, which absorbs heat from the heating/cooling circuit of the building.

In this case, the first way valve 3 in its second position connects the refrigerant distributor 8.1 of the first heat exchanger 8 or the unspecified refrigerant pipe connected thereto to the first connection EE of the first way valve 3, so that refrigerant condensed in the first heat exchanger 8 enters the expansion section 20, in which it takes the same displacement as in FIG. 1*a* and also leaves the expansion section 20 again via the second connection AE of the first way valve 3. In the second position of the first way valve 3, the second connection AE is connected via the corresponding refrigerant pipe to the lower second connection of the second heat exchanger 7, via which the now two-phase refrigerant enters the second heat exchanger 7 in order to be completely vaporised or superheated therein. The refrigerant is metered into the second heat exchanger 7 by means of superheat control of the expansion valve 2 exactly as described in FIG. 1*a*, as the refrigerant passes through the expansion section 20 in the same direction even when the refrigerant circuit is reversed. Due to the further evaporation or superheating of the refrigerant, it rises in the second heat exchanger 7 and leaves it via its upper first connection.

It can be seen that reversing the flow direction of the second heat exchanger 7 has a positive effect on its flow behaviour when the refrigerant circuit is reversed if the second heat exchanger 7 is designed as a vertically arranged plate heat exchanger, like in the present case.

The upper first connection of the second heat exchanger 7 is connected by means of the corresponding refrigerant pipe in the second position of the second way valve 4 to its first connection EK, via which the superheated refrigerant enters the compression section 90, which it passes through in the same way as described in FIG. 1*a* and leaves it again as hot gas at a high pressure level via the second connection AK of the second way valve 4.

In the second position of the second way valve 4 shown in FIG. 1*b*, the second connection AK of the second way valve is connected via the corresponding refrigerant pipe to the manifold 8.2 of the first heat exchanger 8, via which the compressed refrigerant enters the first heat exchanger 8. It can be seen that reversing the direction of flow through the first heat exchanger 8 when the refrigerant circuit is reversed results in a reduction in pressure losses when the hot gas enters the first heat exchanger 8, as the manifold 8.2 causes less restriction than the refrigerant distributor 8.1 on the opposite side. Consequently, reversing the direction of flow when the refrigeration circuit is reversed has a positive effect on the flow behaviour of the first heat exchanger 8 if it is designed as a fin-and-tube heat exchanger, like in the present case.

Figure 2A:
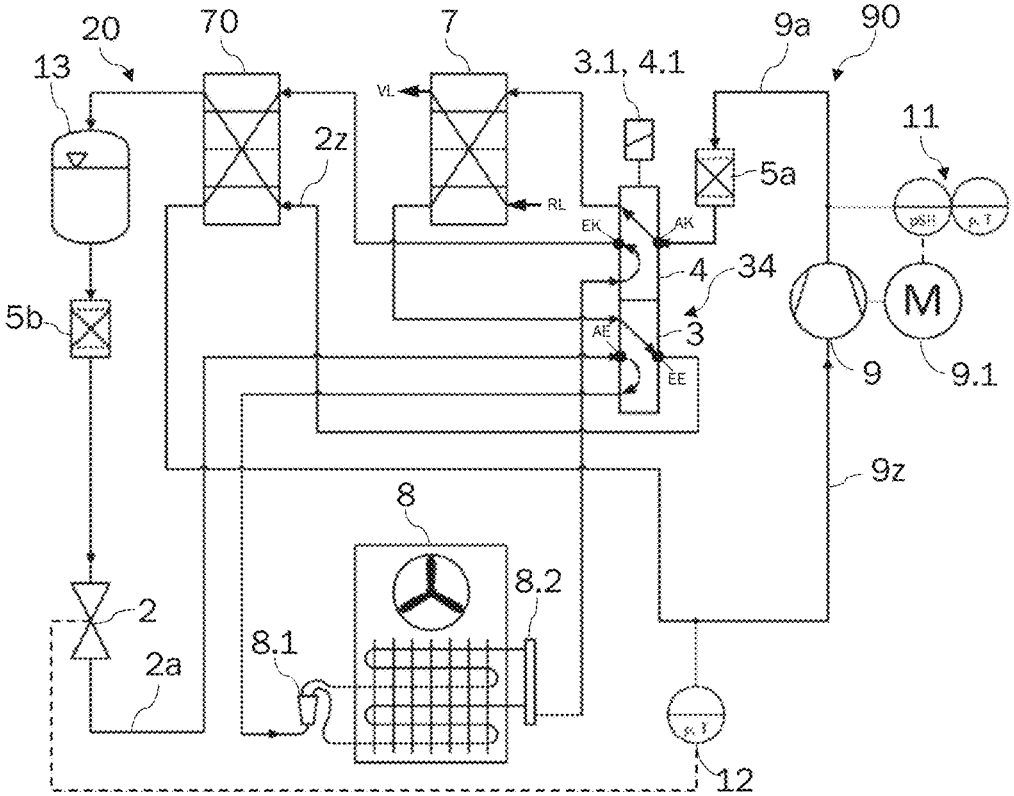
FIGS. 2*a* and 2*b* each schematically show a flow diagram of a refrigerant circuit according to a further design example of the invention, wherein the first and second way valves of the refrigerant circuit are in a first position in FIG. 2*a* and in a second position in FIG. 2*b*.
Figure 2B:
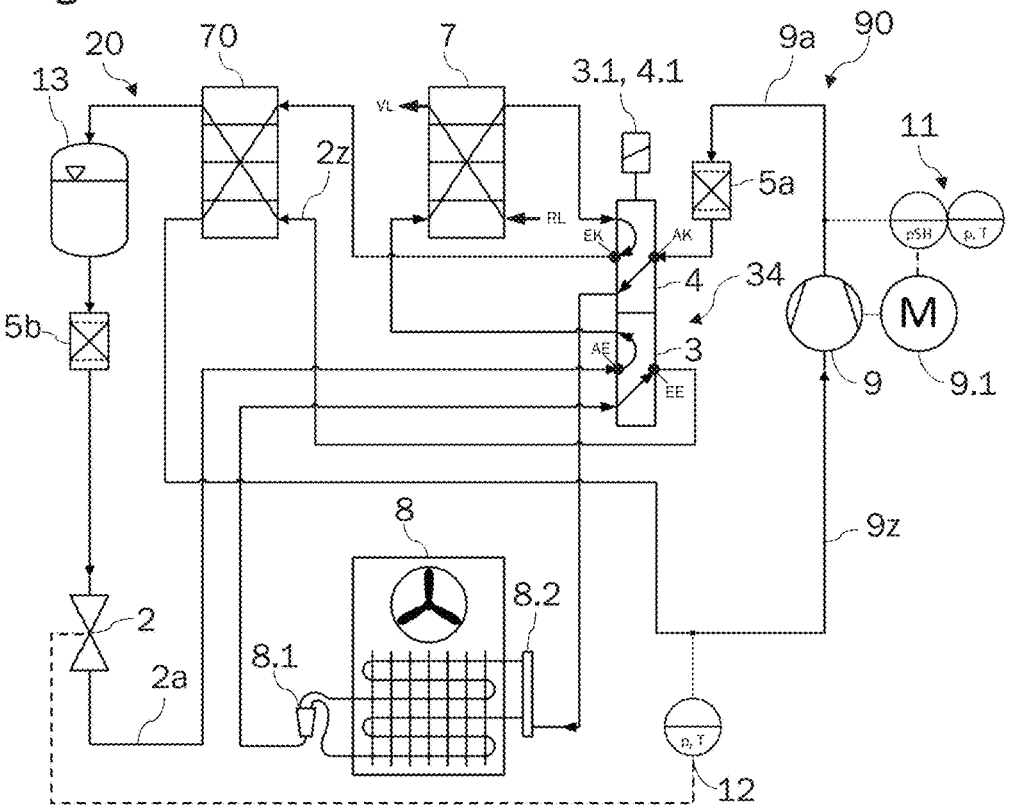

FIGS. 2*a* and 2*b* each schematically show a flow chart of a refrigerant circuit according to a further design example of the invention, wherein the first and second way valves of the refrigerant circuit are in a first position in FIG. 2*a* and in a second position in FIG. 2*b*.

The refrigerant circuit shown in FIGS. 2*a* and 2*b* differs from that shown in FIGS. 1*a* and 1*b* only by an additional internal heat exchanger (third heat exchanger) 70, which is arranged at the inlet of the expansion section 20. Here, an unspecified primary side of the inner heat exchanger 70 is connected to the first connection EE of the first way valve 3 and an unspecified secondary side of the inner heat exchanger 70 is connected to the first connection EK of the second way valve. In this way, a low-pressure suction gas flow from the heat exchanger 8, 7 currently operating as an evaporator is first passed through the inner heat exchanger 70 before it enters the compression section 90, so that the superheating of the refrigerant (suction gas superheating) can take place downstream of the heat exchanger 8, 7 operating as an evaporator, enabling it to operate more efficiently. Since the direction of flow through the primary and secondary sides does not change when the refrigerant circuit is reversed (compare FIG. 2*a* with FIG. 2*b*), integrating an internal heat exchanger 70 into a refrigerant circuit with only one expansion valve is enabled, allowing a more compact design of the refrigerant circuit to be realised.

Based on the design examples shown in FIGS. 1*a* to 2*b*, it becomes clear that the refrigerant circuit disclosed here allows a compact design, in particular due to the constant flow through the expansion section when the circuit is reversed and the design of the first and second way valves, while at the same time offering advantages by changing the direction of flow through the heat exchangers.

The invention claimed is:

1. A refrigerant circuit for heating and cooling a building, comprising a first heat exchanger (8) which is configured to function as an evaporator or as a condenser;

a second heat exchanger (7), which is also configured to function as a condenser or as an evaporator;

a compression section (90) arranged downstream of the first heat exchanger (8) or downstream of the second heat exchanger (7);

an expansion section (20) arranged downstream of the second heat exchanger (7) or downstream of the first heat exchanger (8); and a single actuator (34) that includes a first way valve (3) configured to supply refrigerant to the expansion section (20) and to discharge refrigerant from the expansion section (20) and a second way valve (4) configured to supply refrigerant to the compression section (90) and discharge refrigerant from the compression section (90);

wherein the compression section (90) is arranged upstream of the single actuator (34).

2. The refrigerant circuit according to claim 1, wherein a first connection (EK) of the second way valve (4) is connected to one end of the compression section (90) and a second connection (AK) of the second way valve (4) is connected to the other end of the compression section (90).

3. A heat pump for heating and cooling a building comprising a refrigerant circuit according to claim 1.

4. The refrigerant circuit according to claim 1, wherein the single actuator (34) comprises a block valve that includes the first way valve (3) and the second way valve (4) located within a common housing.

5. The refrigerant circuit according to claim 1, wherein the first way valve (3) is directly connected to the expansion section (20); and the second way valve (4) is directly connected to the compression section (90).

6. The refrigerant circuit according to claim 1, wherein the first and second way valves (3, 4) are configured to switch synchronously from a first position to a second position and vice versa.

7. The refrigerant circuit according to claim 6, wherein the first and second way valves (3, 4) have a common actuating element.

8. The refrigerant circuit according to claim 6, wherein the expansion section (20) is flowed through in the same direction in both positions of the first and second way valves (3, 4).

9. The refrigerant circuit according to claim 6, wherein a first connection (EE) of the first way valve (3) is connected to one end of the expansion section (20) and a second connection (AE) of the first way valve (3) is connected to another end of the expansion section (20).

10. The refrigerant circuit according to claim 9, wherein in the first position of the first and second way valves the first heat exchanger (8) is connected to the second connection (AE) and the second heat exchanger (7) is connected to the first connection (EE) of the first way valve (3).

11. The refrigerant circuit according to claim 9, wherein in the first position of the first and second way valves the first heat exchanger (8) is connected to the first connection (EK) and the second heat exchanger (7) is connected to the second connection (AK) of the second way valve (4).

12. The refrigerant circuit according to claim 9, wherein in the second position of the first and second way valves the second heat exchanger (7) is connected to the second connection (AE) and the first heat exchanger (8) is connected to the first connection (EE) of the first way valve (3).

13. The refrigerant circuit according to claim 9, wherein in the second position of the first and second way valves the second heat exchanger (7) is connected to the first connection (EK) and the first heat exchanger (8) is connected to the second connection (AK) of the second way valve (4).

14. The refrigerant circuit according to claim 1, wherein the expansion section (20) comprises at least one refrigerant receiver (13) and at least one expansion valve (2).

15. The refrigerant circuit according to claim 14, wherein the expansion section comprises a third heat exchanger (70) which is connected to the first connection (EE) of the first way valve (3) and the first connection (EK) of the second way valve (4).

16. The refrigerant circuit according to claim 15, wherein the third heat exchanger (70) is configured to transfer thermal energy from a high-pressure pipe (9*a*) to a low-pressure pipe (9*z*) of the refrigerant circuit.

17. The refrigerant circuit according to claim 15, wherein the third heat exchanger (70) is additionally connected to a suction gas pipe (9*z*) of a compressor (9) in the compression section (90) and to an inlet of the refrigerant receiver (13) in the expansion section (20).

* * * * *